US010195844B2

(12) United States Patent
Ueda

(10) Patent No.: US 10,195,844 B2
(45) Date of Patent: Feb. 5, 2019

(54) LIQUID DISCHARGING APPARATUS, IMAGE PROCESSING APPARATUS AND LIQUID DISCHARGING SYSTEM

(71) Applicant: Shotaro Ueda, Kanagawa (JP)

(72) Inventor: Shotaro Ueda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/455,621

(22) Filed: Mar. 10, 2017

(65) Prior Publication Data

US 2017/0266956 A1 Sep. 21, 2017

(30) Foreign Application Priority Data

Mar. 18, 2016 (JP) ..... 2016-054592
Feb. 23, 2017 (JP) ..... 2017-032061

(51) Int. Cl.
*B41J 2/045* (2006.01)
*B41J 3/407* (2006.01)

(52) U.S. Cl.
CPC ..... *B41J 2/04508* (2013.01); *B41J 2/0458* (2013.01); *B41J 2/04581* (2013.01); *B41J 3/4078* (2013.01)

(58) Field of Classification Search
CPC ..... B41J 3/4078
See application file for complete search history.

(56) References Cited

U.S. PATENT DOCUMENTS 4,302,513 A * 11/1981 Russell ..... B41J 3/00 273/240
2013/0076814 A1* 3/2013 Kanaya ..... B41J 3/4078 347/9
2014/0300676 A1* 10/2014 Miller ..... B41J 3/4078 347/110

FOREIGN PATENT DOCUMENTS

JP 2003-003365 1/2003
JP 2005-089141 4/2005
JP WO 2006036018 A1 * 4/2006 ..... B41J 2/442
JP 2013-096036 5/2013

* cited by examiner

*Primary Examiner* — Shelby L Fidler
(74) *Attorney, Agent, or Firm* — IPUSA, PLLC

(57) ABSTRACT

A liquid discharging apparatus includes a tension applying unit configured to apply a predetermined tension capable of stretching an object, to the object; and a liquid discharging unit configured to discharge liquid on the object that is stretched by the predetermined tension applied by the tension applying unit to form a an original image or a corrected image of the original image on the object, the corrected image being corrected by a degree of stretching of a predetermined image when the object on which the predetermined image is formed is stretched by applying the predetermined tension to the object.

11 Claims, 13 Drawing Sheets

2

LIQUID DISCHARGING APPARATUS, IMAGE PROCESSING APPARATUS AND LIQUID DISCHARGING SYSTEM

CROSS-REFERENCE TO RELATED APPLICATION

The present application is based on and claims the benefit of priority of Japanese Priority Application No. 2016-054592 filed on Mar. 18, 2016, and Japanese Priority Application No. 2017-032061 filed on Feb. 23, 2017, the entire contents of which are hereby incorporated by reference.

BACKGROUND OF THE INVENTION

1. Field of the Invention

The present invention relates to a liquid discharging apparatus, an image processing apparatus and a liquid discharging system.

2. Description of the Related Art

Clothing manufacturers or cloth manufactures perform "textile printing" by which patterns or the like are printed on a surface of a cloth. A liquid discharging apparatus that is configured to print ink discharged from a liquid discharging head on a cloth has been developed.

However, different from paper, wrinkles are easily generated in such a material like a cloth, and such wrinkles may cause bad effects on printing results. Thus, a technique capable of applying flexible tension on a material on which an image is to be printed (hereinafter, simply referred to as a "print target material") in accordance with a type of the print target material to appropriately reduce or remove wrinkles of the print target material is suggested (see Patent Document 1, for example).

According to the conventional liquid discharging apparatus, an image is formed under a state in which tension, by which wrinkles of a print target material are appropriately reduced or removed but the print target material is not stretched, is applied on the print target material.

However, with such tension, even though an appropriate image can be once printed, there is a risk that the print target material contacts a liquid discharging head due to fuzzing or the like of the print target material and a printed surface becomes foul. This may cause waste of the print target materials due to misprint. Further, as a fixing force on the print target material is weak, there is a risk that an image is deformed as the print target material tilts due to oscillation during printing, or as the print target material may not be horizontally retained.

Patent Document

[Patent Document 1] Japanese Unexamined Patent Application Publication No. 2013-96036

SUMMARY OF THE INVENTION

The present invention is made in light of the above problems, and provides a liquid discharging apparatus capable of forming an appropriate image on an object.

According to an embodiment, there is provided a liquid discharging apparatus including a tension applying unit configured to apply a predetermined tension capable of stretching an object, to the object; and a liquid discharging unit configured to discharge liquid on the object that is stretched by the predetermined tension applied by the tension applying unit to form a an original image or a corrected image of the original image on the object, the corrected image being corrected by a degree of stretching of a predetermined image when the object on which the predetermined image is formed is stretched by applying the predetermined tension to the object.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
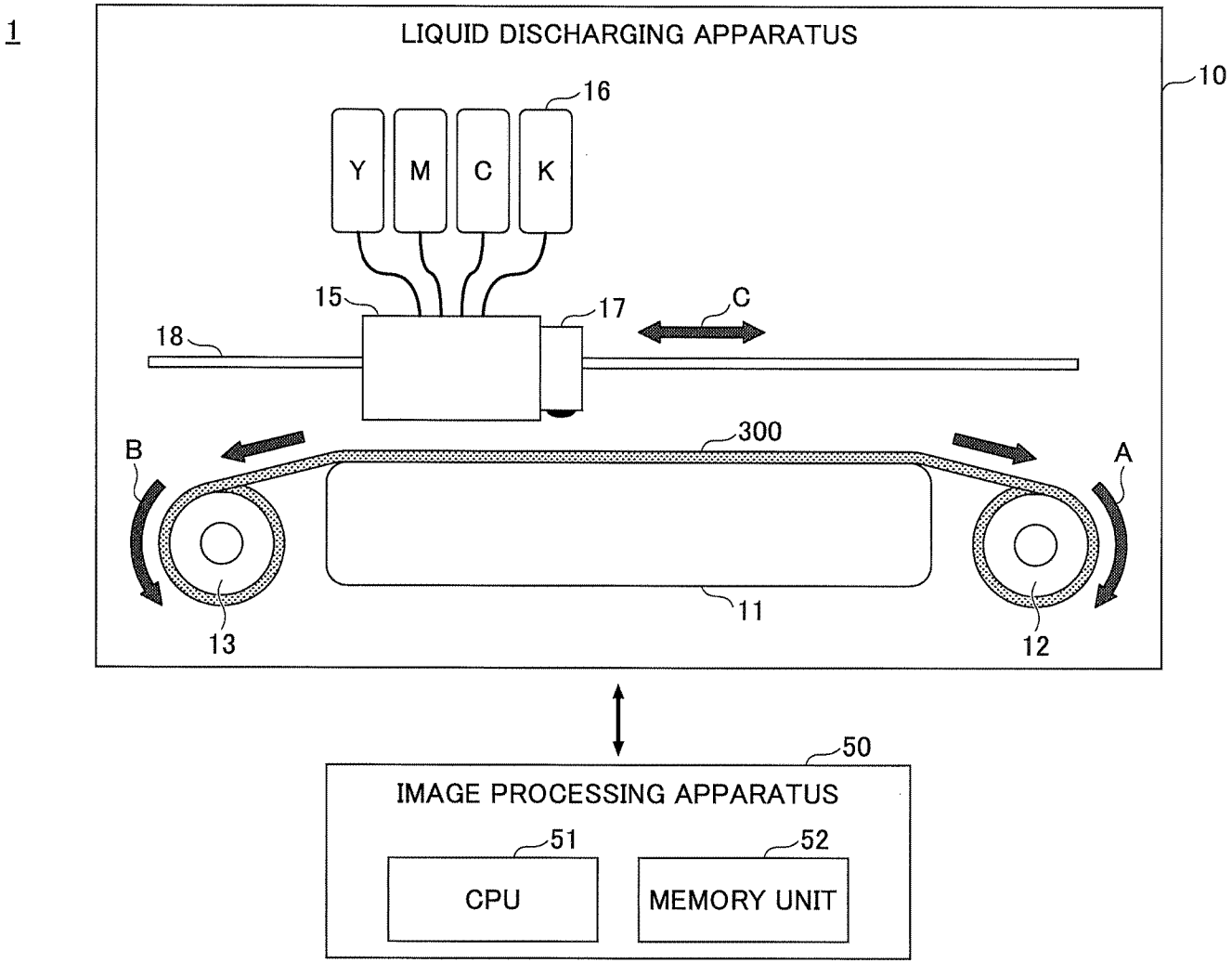
FIG. 1 is a view illustrating an example of a structure of a liquid discharging system of a first embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

In order to avoid the above described problems caused by a print target material like a cloth, it is preferable that tension that can stretch the print target material is applied to the print target material. However, if an image is printed on the print target material under a state that the print target material is stretched, the image is shrunk when the stretching of the print target material is released. Thus, an appropriate image (a proper image to be printed) cannot be printed. Here, the print target material may be any materials capable of stretching. According to the embodiments, a technique capable of printing (forming) an appropriate image on a print target object under a state that the print target object is stretched is provided.

First Embodiment

FIG. 1 is a view illustrating an example of a structure of a liquid discharging system 1 of a first embodiment. With reference to FIG. 1, the liquid discharging system 1 includes a liquid discharging apparatus 10 and an image processing apparatus 50 as main constituents. The liquid discharging apparatus 10 and the image processing apparatus 50 may be connected by wired or wireless communication.

(Liquid Discharging Apparatus)

In the liquid discharging apparatus 10, a print target object 300 (hereinafter, simply referred to as an "object 300" as well) is mounted on a fixed table 11. Both edges of the object 300 are wound around a first roller 12 (first rotator) and a second roller 13 (second rotator), respectively. The object 300 is a print target of the liquid discharging apparatus 10 on which an image is to be printed by the liquid discharging apparatus 10, and is not a constituent of the liquid discharging apparatus 10.

The first roller 12 and the second roller 13 are configured to be rotatable by stepping motors, respectively, for example. When the first roller 12 is rotated in a direction of an arrow A, and the second roller 13 is rotated in a direction of an arrow B, tension corresponding to the rotations can be applied on the object 300.

Figure 2:
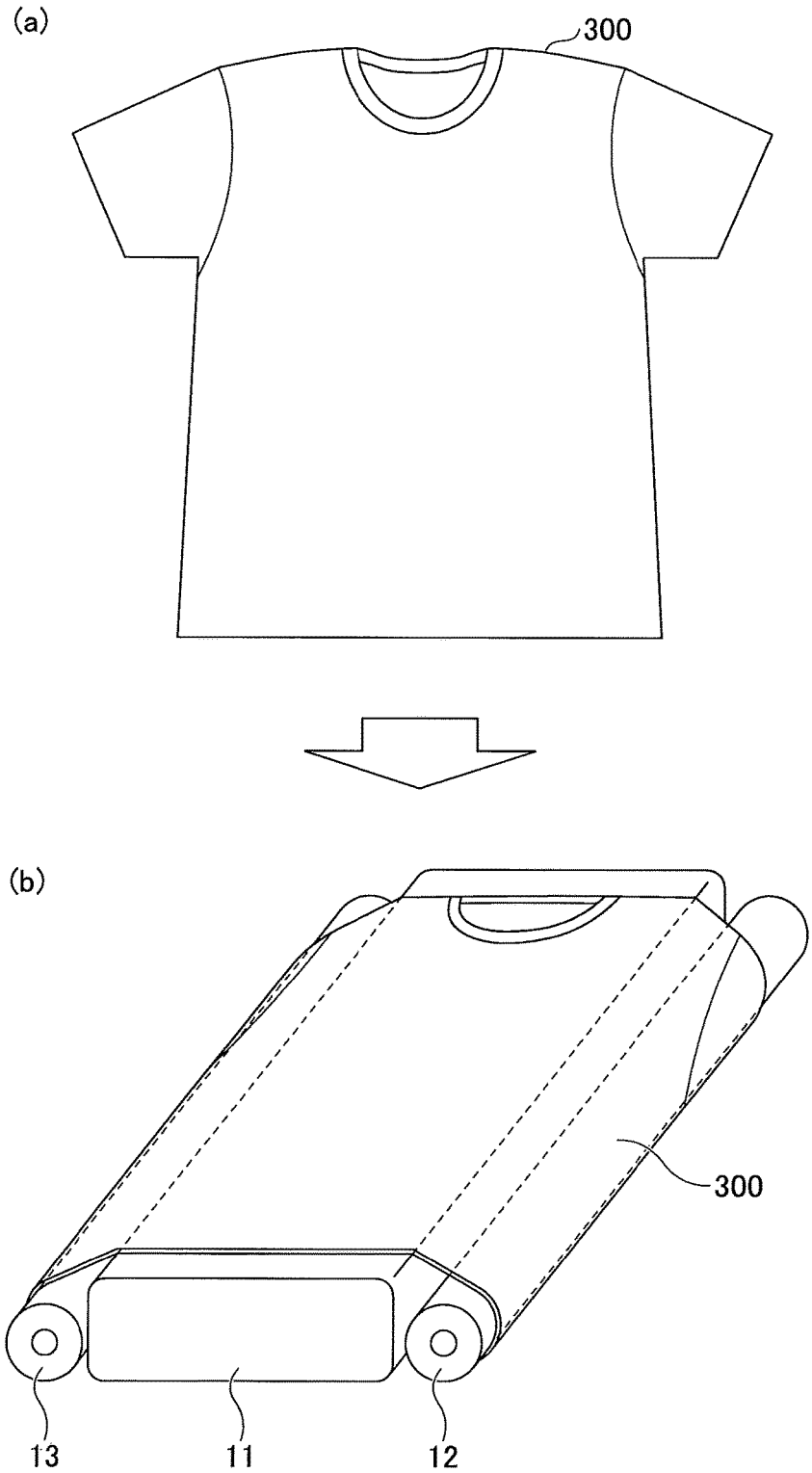
FIG. 2 is a view illustrating an example of a print target object.

As illustrated in FIG. 2, the object 300 is a T-shirt made of cotton, hemp, polyester, nylon (registered trademark) or the like, for example. For the object 300, it is preferable to use a type of a material that has high resistance against shrinking, and that can recompressed even when tension causing the object 300 to stretch is applied. Cotton, hemp, polyester or nylon satisfies this condition. Further, a material capable of stretching such as leather may be used as the object 300 as well. However, as wool, silk or rayon has low resistance against shrinking, and it is difficult for wool, silk or rayon to recompress after once being stretched, if such a material is used, it is necessary to limit a degree of stretching.

Referring back to FIG. 1, a liquid discharging head 15 is provided at a position facing an upper surface of the fixed table 11 while interposing the object 300 between the liquid discharging head 15 and the fixed table 11. Liquids (inks) are supplied from cartridges 16 of black (K), cyan (C), magenta (M) and yellow (Y), for example, to the liquid discharging head 15.

A camera 17 is provided at a side surface of the liquid discharging head 15 as a photograph unit for photographing an image printed (formed) on the object 300. For the camera 17, a Charge Coupled Device (CCD) camera, a Complementary Metal Oxide Semiconductor (CMOS) camera or the like may be used, for example. The liquid discharging head 15 and the camera 17 are configured to be capable of reciprocating in directions of arrows C along a guide member 18.

The object 300 placed on the fixed table 11, under a state that the both edges of it are wound around the first roller 12 and the second roller 13, respectively, may be configured to be capable of transferring in a direction perpendicular to a direction guided by the guide member 18.

The liquid discharging head 15 discharges ink by applying a stimulus to the ink. The stimulus is not specifically limited, and the stimulus can be arbitrarily selected in accordance with the purpose. For the stimulus, heat (temperature), pressure, oscillation, light or the like may be used. These may be singularly used, or may be used in combination. Among them, heat or pressure is preferably used.

As a specific example, a piezoelectric actuator such as a piezoelectric element, a thermal actuator that uses phase change by film boiling of liquid using an electrothermal element such as a heat element, a shape memory alloy actuator that uses metal phase change by temperature change, a static actuator that uses electrostatic force or the like may be used.

An embodiment of discharging ink is not specifically limited, and may be different in accordance with the type of the stimulus. For example, when the stimulus is heat, the ink may be discharged as follow, for example. Thermal energy corresponding to a printing signal is applied to the ink in the liquid discharging head 15 using a thermal head or the like, for example, to cause the ink to generate bubbles by the thermal energy. Then, ink is injected and discharged as droplets from nozzle holes of the liquid discharging head 15 by the pressure of the bubbles.

Alternatively, when the stimulus is pressure, the ink may be discharged as follow, for example. Voltage is applied to a respective piezoelectric element that is adhered to a position called a pressure room in an ink channel in the liquid discharging head 15. Then, the piezoelectric element is deflected to contract the volume of the pressure room so that the ink is injected and discharged as droplet from the nozzle hole of the liquid discharging head 15.

Figure 3:
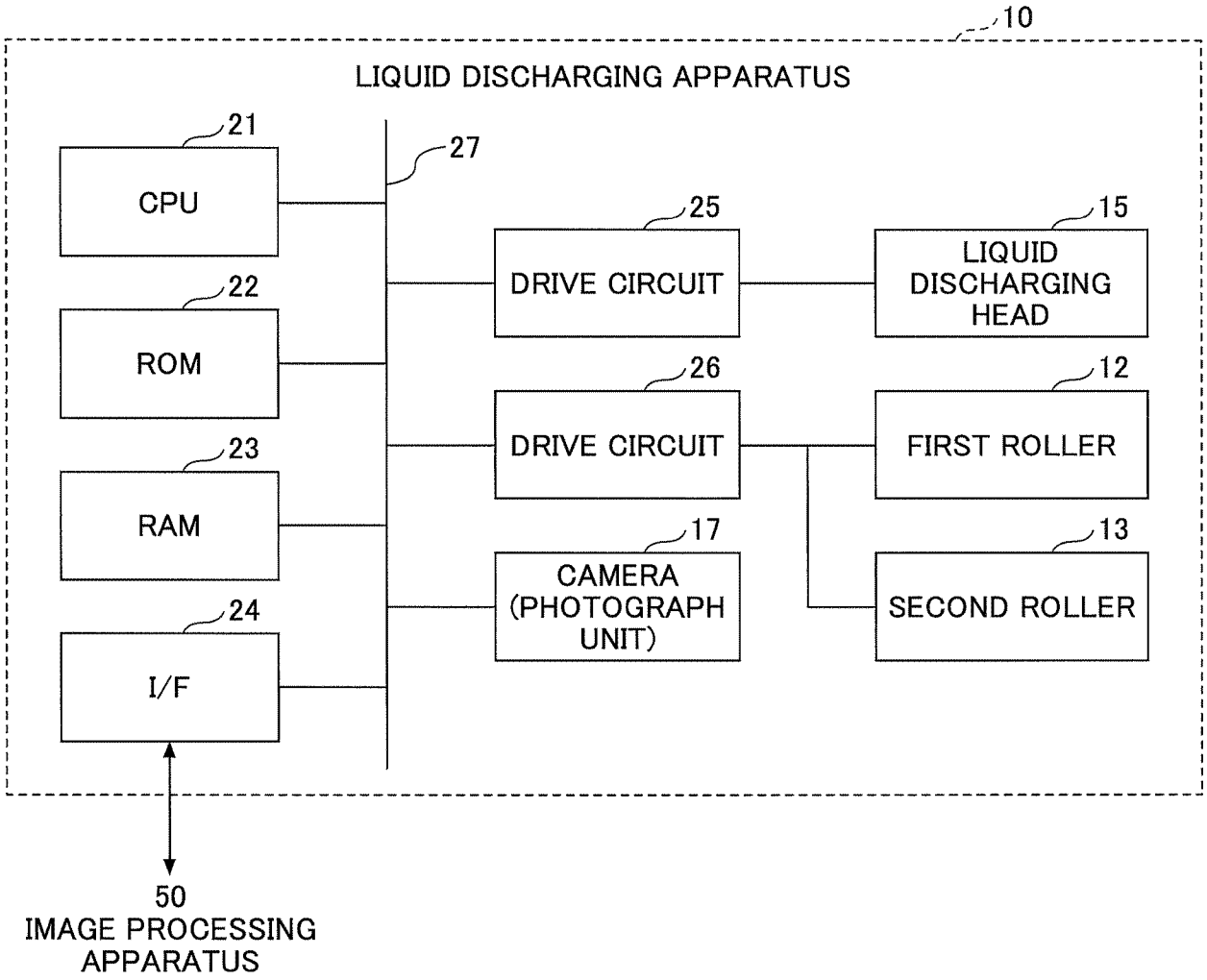
FIG. 3 is a view illustrating an example of a hardware structure of a liquid discharging apparatus.
Figure 4:
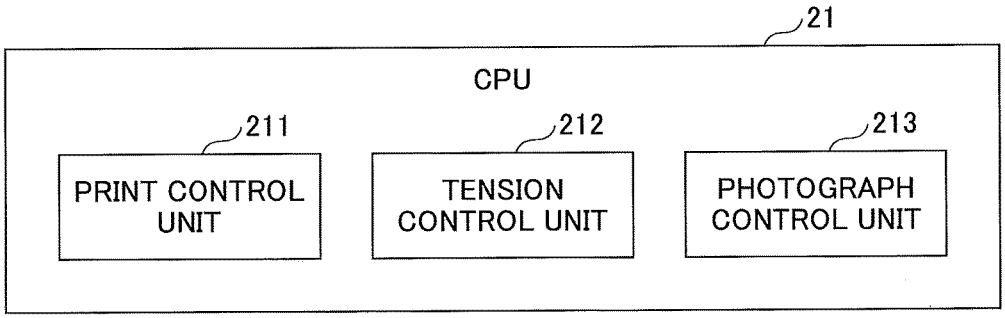
FIG. 4 is a view illustrating an example of functions of a CPU of the liquid discharging apparatus.

FIG. 3 is a view illustrating an example of a hardware structure of the liquid discharging apparatus 10. FIG. 4 is a view illustrating an example of functions of a CPU of the liquid discharging apparatus 10.

As illustrated in FIG. 3, the liquid discharging apparatus 10 includes the first roller 12, the second roller 13, the liquid discharging head 15 and the camera 17. In addition, the liquid discharging apparatus 10 further includes a Central Processing Unit (CPU) 21, a Read Only Memory (ROM) 22, a Random Access Memory (RAM) 23, an interface (I/F) 24 and drive circuits 25 and 26. The camera 17, the CPU 21, the ROM 22, the RAM 23, the I/F 24, the drive circuit 25 and the drive circuit 26 are connected with each other via a bus 27.

The CPU 21 uses the RAM 23 as a main memory, a working area or the like. The CPU 21 has a function to control the entirety of various operations of the liquid discharging apparatus 10 by reading out programs stored in the ROM 22 or the like and executing them, for example. For example, as illustrated in FIG. 4, the CPU 21 includes a function as a print control unit 211, a function as a tension control unit 212 and a function as a photograph control unit 213. The CPU 21 may include other functions, if necessary.

The print control unit 211 may control the liquid discharging head 15 via the drive circuit 25 to print (form) a predetermined image.

The tension control unit 212 may control the first roller 12 and the second roller 13 via the drive circuit 26 to apply desired tension on the object 300. The first roller 12 and the second roller 13 are a typical example of a tension applying unit.

The photograph control unit 213 may control the camera 17 to photograph a predetermined image or the like.

The I/F 24 functions as an interface when communicating with the image processing apparatus 50. The CPU 21 is capable of receiving image data for printing an image from the image processing apparatus 50, sending image data obtained by the camera 17 for generating corrected image data to the image processing apparatus 50, and sending and receiving various instructions, via the I/F 24.

According to the liquid discharging apparatus 10, liquid (ink) is discharged from the liquid discharging head 15 on the object 300 that is stretched by a predetermined tension by the first roller 12 and the second roller 13, and an image corresponding to corrected image data (described later) is printed. Here, although a serial scan head is illustrated in FIG. 1 in the liquid discharging apparatus 10, the liquid discharging apparatus 10 may use a line scan head.

(Image Processing Apparatus)

Referring back to FIG. 1, the image processing apparatus 50 has a function to generate image data, that is used when the liquid discharging apparatus 10 prints an image on the object 300, and send it to the liquid discharging apparatus 10. The image processing apparatus 50 includes a CPU 51 and a memory unit 52 as main constituents.

The CPU 51 has a function to control the entirety of various operations of the image processing apparatus 50. The memory unit 52 stores various data necessary for the operation of the CPU 51. The memory unit 52 may be configured by a nonvolatile semiconductor device, for example. Alternatively, the memory unit 52 may be a hard disk drive, an optical disk drive or the like.

The image processing apparatus 50 is a personal computer, for example, but not limited so. Alternatively, the image processing apparatus 50 may be a specific apparatus that has a function to generate image data, that is used when the liquid discharging apparatus 10 prints an image on the object 300, and send it to the liquid discharging apparatus 10, for example.

Figure 5:
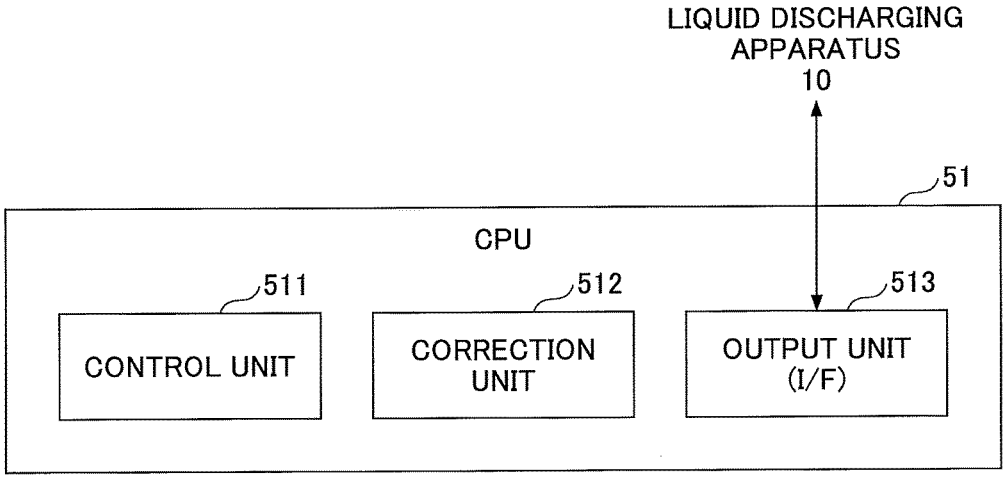
FIG. 5 is a view illustrating an example of functions of an image processing apparatus.

FIG. 5 is a view illustrating an example of functions of the image processing apparatus 50. With reference to FIG. 5, the CPU 51 includes a function as a control unit 511, a function as a correction unit 512 and a function as an output unit 513. The CPU 51 may include other functions, if necessary.

As described above, according to the embodiment, the liquid discharging apparatus 10 prints an image on the object 300 under a state that the object 300 is stretched by the applied predetermined tension. Thus, the printed image is shrunk after the tension applied on the object 300 is released. Thus, when an image is printed using original image data, which is prepared for printing on an object that is not stretched, an appropriate image (a proper image to be printed) corresponding to the original image data cannot be print on the object 300.

Here, the original image data is original data of an image to be printed on the object 300, and if an image is printed on the object 300, under a state that the object 300 is not stretched, using the original image data, an appropriate image corresponding to the original image data can be printed on the object 300.

Thus, according to the liquid discharging system 1, an image is printed (formed) on the object 300 that is stretched by the applied predetermined tension using corrected image data which is obtained by correcting the original image data. The correction unit 512 of the image processing apparatus 50 generates the corrected image data. The corrected image data generated by the correction unit 512 is sent to the liquid discharging apparatus 10 by the output unit 513.

Here, the corrected image data is data obtained by, printing a predetermined image on the object 300, which is not stretched, using the original image data, stretching the object 300 on which the predetermined image is printed by applying a predetermined tension, and correcting the original image data based on a degree of stretching of the predetermined image printed on the stretched object 300. This process is described later in detail.

The CPU 21 of the liquid discharging apparatus 10 receives the corrected image data from the output unit 513 of the image processing apparatus 50 via the I/F 24, and prints an image on the object 300 stretched by the predetermined tension using the corrected image data. With this, it is possible to print (form) an appropriate image corresponding to the original image data when the predetermined tension is released.

Figure 6:
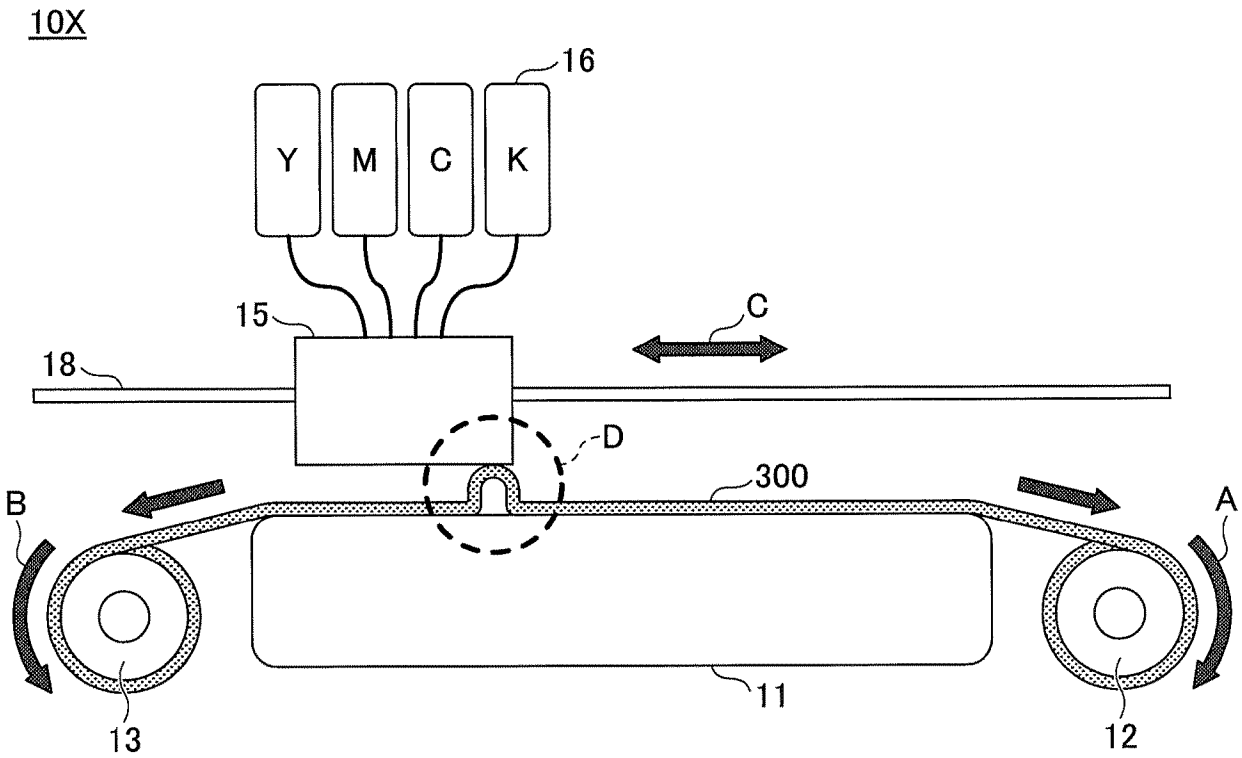
FIG. 6 is a view illustrating an example of a liquid discharging apparatus of a reference example.

FIG. 6 is a view illustrating an example of a liquid discharging apparatus 10X of a reference example. The liquid discharging apparatus 10X of the reference example is different from the liquid discharging apparatus 10 (see FIG. 1) in that the camera 17 is not included, and an image is printed on the object 300 under a state that only tension that does not cause the object 300 to be stretched is applied using the original image data.

As tension sufficient to stretch the object 300 is not applied to the object 300 in the liquid discharging apparatus 10X, it is possible to print an appropriate image on the object 300 corresponding to the original image data without correcting the original image data.

However, without applying tension sufficient to stretch the object 300, the object 300 may float from the fixed table 11 as illustrated in FIG. 6. In such a case, as illustrated by a broken circle D, the object 300 may contact the liquid discharging head 15, and problems such as ink undesirably adheres to the object 300 and a paper jam occurs may happen with high possibility. Furthermore, as described above, due to fuzzing of the object 300, such problems may easily occur.

On the other hand, according to the liquid discharging apparatus 10 illustrated in FIG. 1, as tension sufficient to stretch the object 300 is applied, in other words, as tension stronger than that applied by the liquid discharging apparatus 10X is applied on the object 300, floating of the object 300 can be suppressed. As a result, problems such as ink adheres to the object 300 and a paper jam occurs can be avoided, and waste of the objects 300 due to misprint can be reduced.

However, according to the liquid discharging apparatus 10 illustrated in FIG. 1, an image is printed under a state that tension capable of stretching the object 300 (larger than tension within a range that does not stretch the object 300) is applied, it is necessary to print an image using corrected image data as will be described in the following in order to obtain an appropriate image.

The "tension within a range that does not stretch the object 300" means tension within a range that, when an image is printed on an image forming area of the object 300 using the original image data, an original image can be appropriately printed without correcting the original image data as described in the embodiment. As the tension applied by the tension applying unit may transmit differently to different areas of the object 300, based on the type of the object 300, the "tension within a range that does not stretch the object 300" may be applicable to at least the image forming area.

(Generation of Corrected Image Data)

Figure 7:
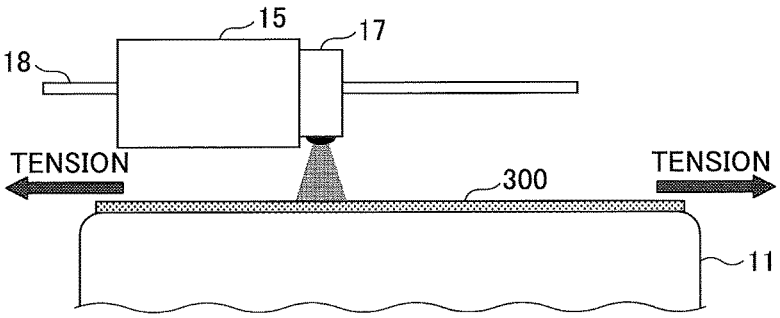
FIG. 7 is a view for describing calculation of a degree of stretching when tension is applied.

FIG. 7 is a view for describing calculation of a degree of stretching when tension is applied. FIG. 7 corresponds to an enlarged view of a part of FIG. 1.

When calculating the degree of stretching of the object 300 (the degree of stretching of the image printed on the object 300) caused by applying the tension, the control unit 511 of the image processing apparatus 50 outputs an instruction to the liquid discharging apparatus 10 via the output unit 513.

Figure 8A:
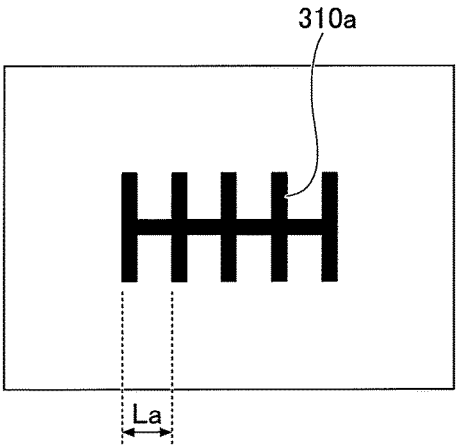
FIG. 8A and FIG. 8B are views illustrating an example of a test pattern to be printed on the print target object.

Upon receiving the instruction, first, the liquid discharging apparatus 10 prints a test pattern on the object 300 under a state that tension T1, which is within a range that the object 300 is not stretched, is applied on the object 300. For example, the liquid discharging apparatus 10 prints a ladder pattern 310*a* (original image) as illustrated in FIG. 8A as the test pattern on the object 300.

The ladder pattern 310*a* may be printed at an edge portion of the object 300 so that the ladder pattern 310*a* cannot be distinguished, for example. Then, the ladder pattern 310*a* printed on the object 300 is photographed by the camera 17. Data of the photographed image (referred to as "first image data") is sent to the image processing apparatus 50, and stored in the memory unit 52 of the image processing apparatus 50.

Figure 8B:
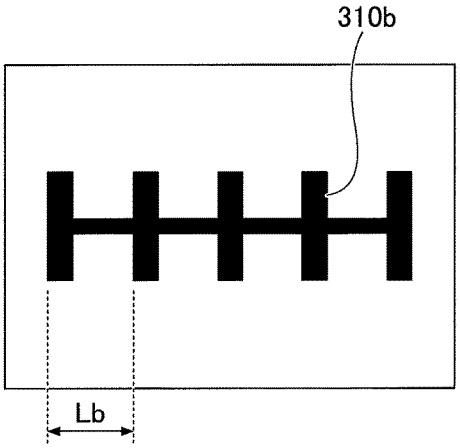

Next, after printing the ladder pattern 310*a*, tension T2 by which the object 300 is stretched is applied. At this time, the ladder pattern 310*a* illustrated in FIG. 8A extends in a direction in which the tension T2 is applied to be a ladder pattern 310*b* as illustrated in FIG. 8B. The ladder pattern 310*b* (extended (or stretched) original image) is photographed by the camera 17. Data of the photographed image (referred to as "second image data") is sent to the image processing apparatus 50 and stored in the memory unit 52 of the image processing apparatus 50.

Here, the tension T2 is tension by which the object 300 is stretched, but less than a stretch limit value. The stretch limit value means a minimum value of tension by which the object 300 cannot return to its original shape when the tension is released.

Next, the correction unit 512 reads out the first image data and the second image data from the memory unit 52, and obtains a length "La" between ladders of the ladder pattern 310*a* adjacent to each other in a direction in which the tension is applied, and a length "Lb" between ladders of the ladder pattern 310*b* adjacent to each other in a direction in which the tension is applied by image processing. Then, the correction unit 512 generates corrected image data obtained by correcting the original image data based on the length "La" and the length "Lb" (degree of stretching of the original image after the tension T2 is applied with respect to the original image before the tension T2 is applied), and stores it in the memory unit 52 of the image processing apparatus 50. The corrected image data corresponds to an image of the original image data that is extended by "Lb/La" in a direction in which the tension T2 is applied.

Figure 9:
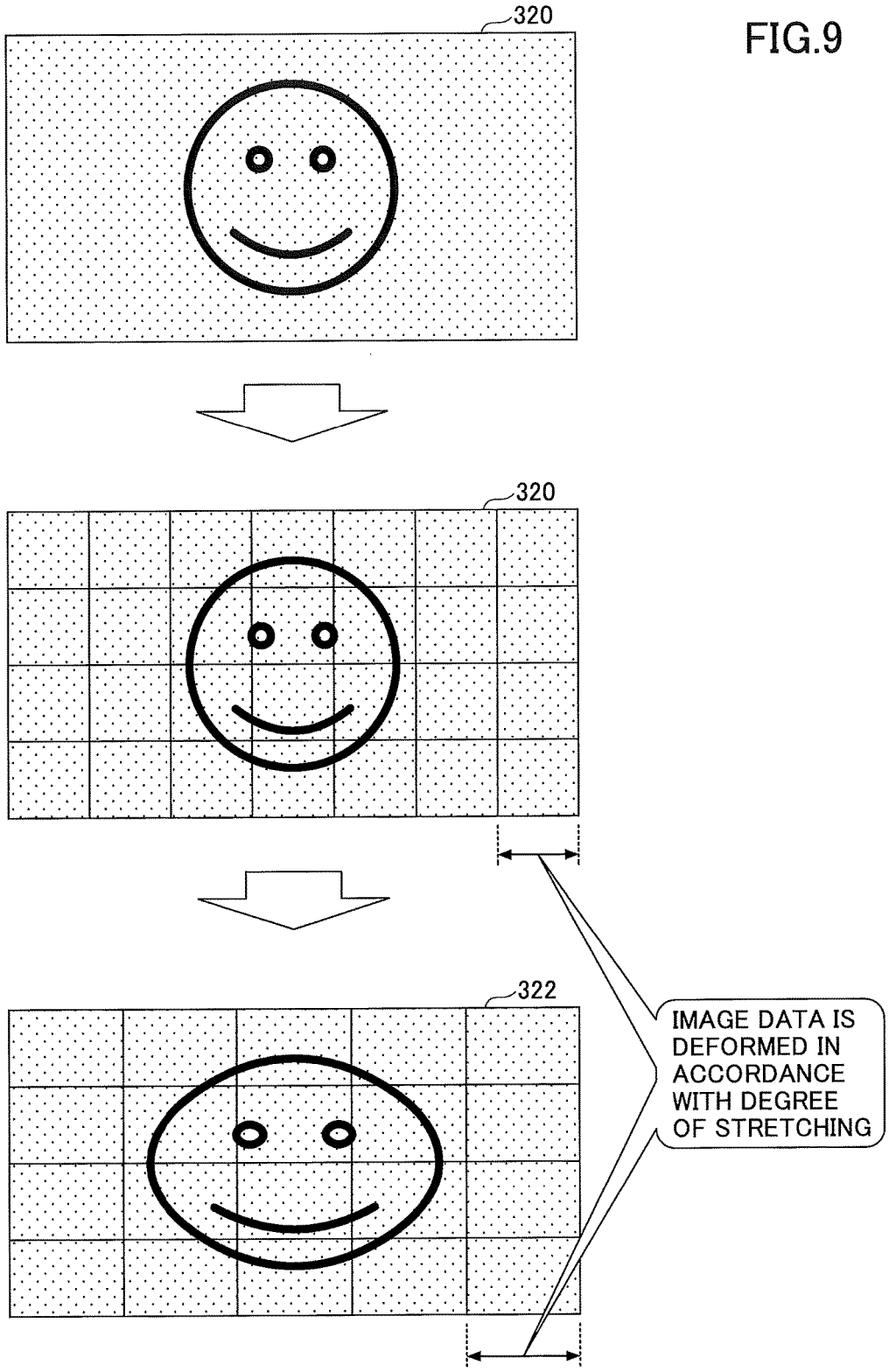
FIG. 9 is a view schematically illustrating generation of corrected image data.

FIG. 9 is a view schematically illustrating generation of corrected image data. As illustrated in FIG. 9, first, original image data 320 of (a) is divided by "N" grids as illustrated in (b). The number of divided grids "N" may be arbitrarily determined based on an image size. Next, a lateral direction (a direction in which the tension is applied) of each area divided by the grids of the original image data 320 of (b) is extended (deformed) as illustrated in (c) in accordance with the detected degree of stretching of the object 300 to obtain corrected image data 322.

For the example described above with reference to FIG. 7, FIG. 8A and FIG. 8B, the degree of stretching of the original image after the tension T2 is applied with respect to the original image before the tension T2 is applied is "Lb/La". Thus, by extending each of the divided areas by "Lb/La" in a direction in which the tension is applied, the corrected image data 322 as illustrated in (c) of FIG. 9 can be generated.

Then, an image is printed on the object 300 under a state that the tension T2 is applied on the object 300 using the corrected image data 322 illustrated in (c) of FIG. 9. If an image is printed on the object 300 under a state that the object 300 is stretched by applying the tension T2 using the original image data 320 (see (a) and (b) of FIG. 9), as the object 300 is shrunk under a normal state (when the tension T2 is released), the printed image is also shrunk with the shrinking of the object 300.

However, according to the liquid discharging system 1, an image is printed using the corrected image data which is generated by taking shrinking of the object 300 into consideration under a state that the object 300 is stretched by applying the tension T2. Thus, even when the tension T2 is released, deformation of the image does not occur due to the shrinking of the object 300. Thus, an image same as the original image can be retained under a normal state (when the tension T2 is released).

(Suppression of Lowering of Density)

Figure 10:
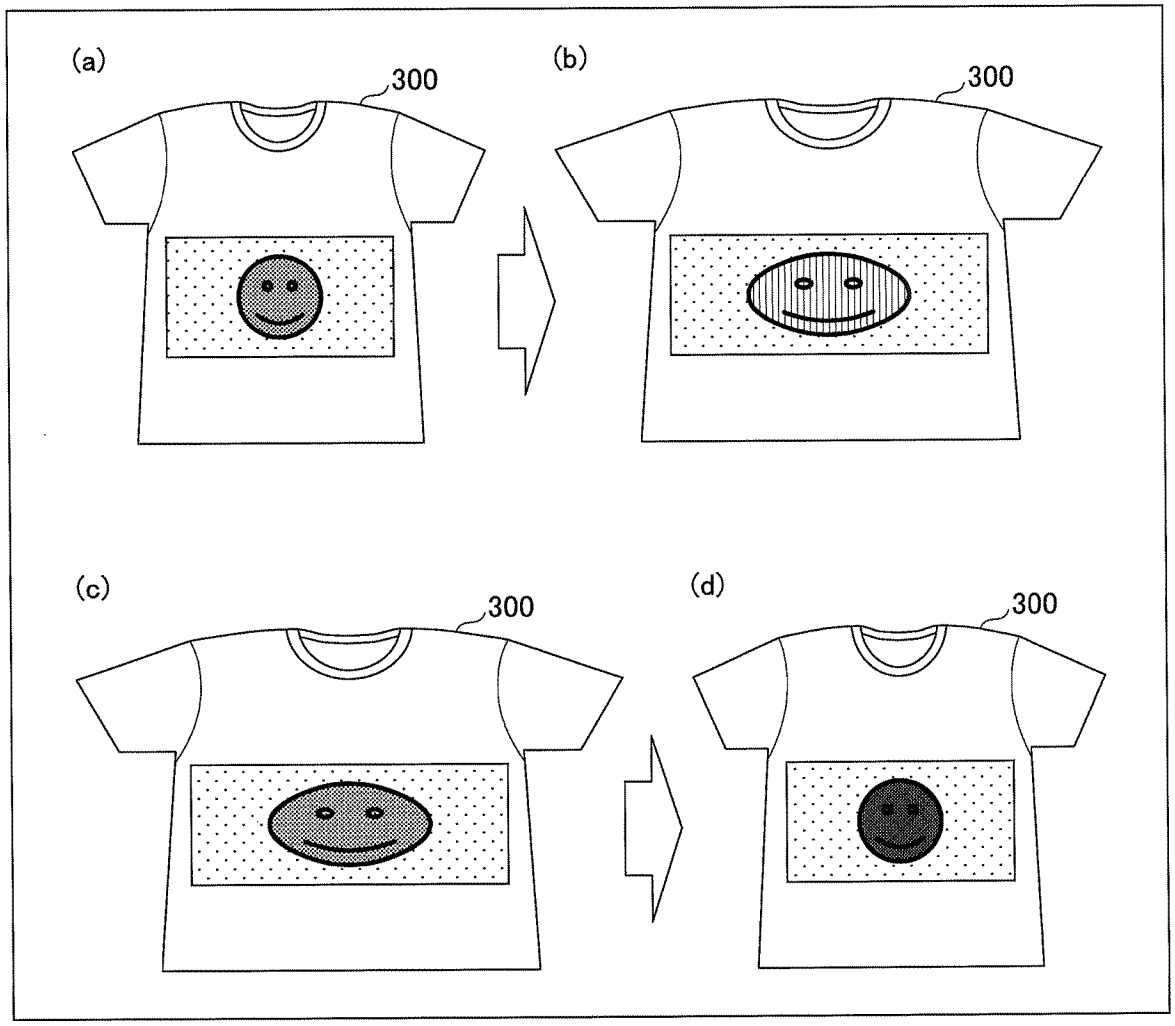
FIG. 10 is a view for describing suppressing lowering of density.

FIG. 10 is a view for describing suppression of lowering of density by the image processing apparatus 50 of the first embodiment. A cloth is formed by net of fibers and has high elasticity. Thus, even for an image as illustrated in (a) in which the image is printed without gaps under the normal state, when the cloth is extended as illustrated in (b), gaps between a net become large and strips along the gaps may be generated.

The state that the object 300 is stretched by applying the tension T2 is a state under which the cloth is extended. In other words, as it is possible to print an image on the object 300 under a state that the object 300 is stretched by the liquid discharging system 1, it is possible to print an image at the gaps between the net as illustrated in (c), which was impossible by a conventional technique. With this, lowering of density due to the strips when the cloth (object) is extended can be suppressed. By suppressing lowing of density, image quality can be improved.

Further, when the image printed under the state that the cloth is stretched as illustrated in (c) is shrunk as illustrated in (d) after the tension is released, the density at the printed surface becomes high and the concentration is improved. With this, more bright color can be printed, compared with a conventional method.

(Process Flow of Liquid Discharging System)

Figure 11:
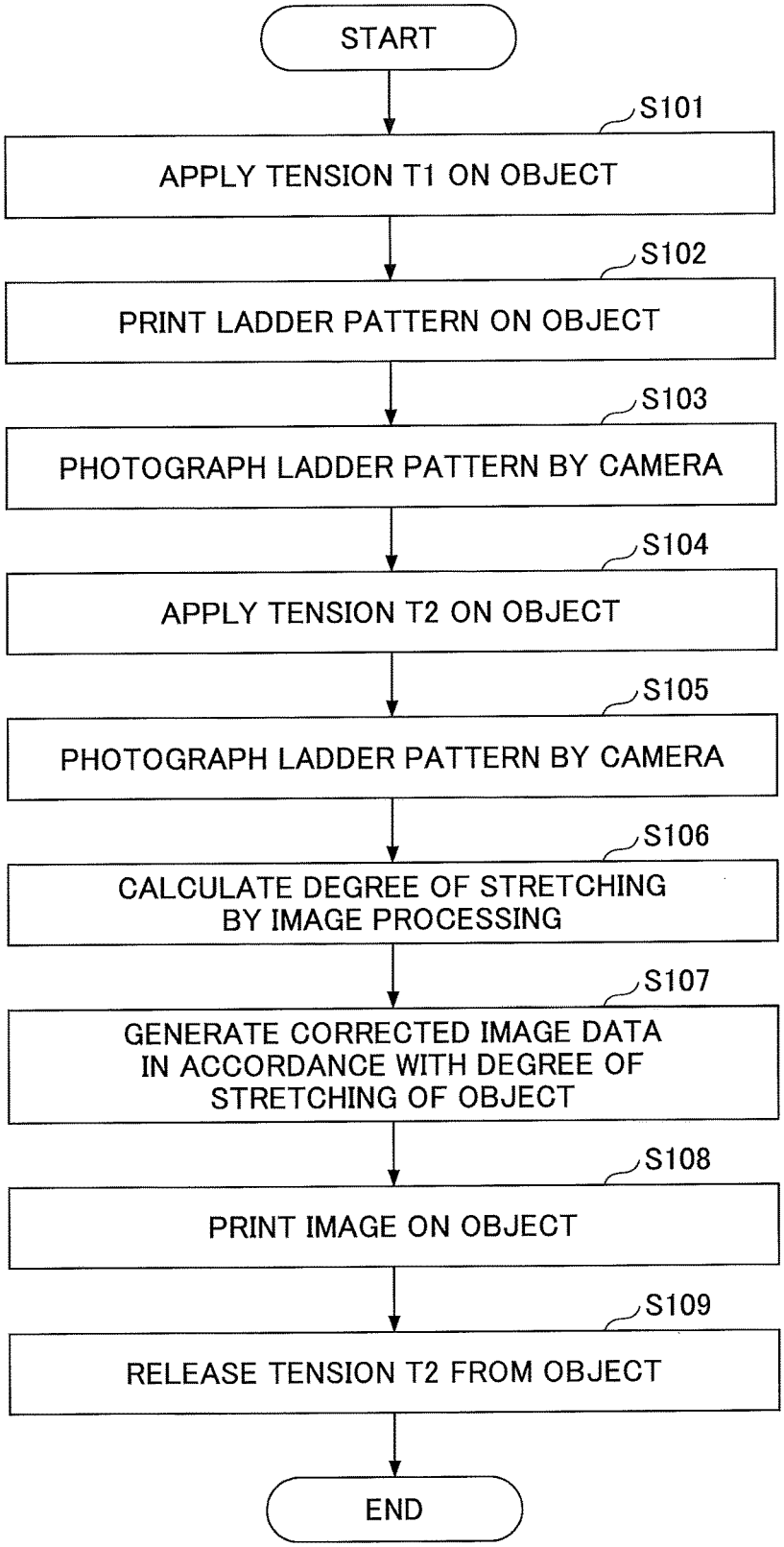
FIG. 11 is a view illustrating an example of a process flow of the liquid discharging system of the first embodiment.

FIG. 11 is a view illustrating a process flow of the liquid discharging system 1 of the first embodiment. FIG. 11 illustrates an example of the process flow from applying tension to forming image.

First, an operator of the liquid discharging system 1 selects a type of a print target object (hereinafter, simply referred to as a "target" as well) on which an image is to be printed, and inputs the kind in the image processing apparatus 50. The type of the object is selected from cotton, hemp, polyester and nylon, for example.

Then, in step S101, the control unit 511 of the image processing apparatus 50 reads out tension T1 corresponding to the selected kind from the memory unit 52, and outputs an instruction to the liquid discharging apparatus 10 via the output unit 513 to apply the tension T1 to the object. Upon receiving the instruction, the tension control unit 212 of the liquid discharging apparatus 10 controls the drive circuit 26 to rotate the first roller 12 and the second roller 13 in predetermined directions, respectively, to apply the tension T1 to the object. Here, the tension T1 is within a range that the object is not stretched, and a value of the tension T1 is previously stored in the memory unit 52 in correspondence with the type of the object.

Next, in step S102, the correction unit 512 of the image processing apparatus 50 outputs an instruction to the liquid discharging apparatus 10 via the output unit 513 to print the ladder pattern 310*a* (see FIG. 8A) at an edge portion of the like of the object. Upon receiving the instruction, the print control unit 211 of the liquid discharging apparatus 10 controls the drive circuit 25 to operate the liquid discharging head 15 to print the ladder pattern 310*a* (see FIG. 8A) at the edge portion or the like of the object.

Next, in step S103, the control unit 511 of the image processing apparatus 50 outputs an instruction to the liquid discharging apparatus 10 via the output unit 513 to photograph the printed ladder pattern 310*a* by the camera 17. Upon receiving the instruction, the photograph control unit 213 of the liquid discharging apparatus 10 controls the camera 17 to photograph the printed ladder pattern 310*a*. Photographed image data (first image data) is sent to the image processing apparatus 50, and stored in the memory unit 52 of the image processing apparatus 50.

Next, in step S104, the control unit 511 of the image processing apparatus 50 reads out tension T2 corresponding to the selected kind (material) from the memory unit 52, and outputs an instruction to the liquid discharging apparatus 10 via the output unit 513 to apply the tension T2 to the object. Upon receiving the instruction, the tension control unit 212 of the liquid discharging apparatus 10 controls the drive circuit 26 to rotate the first roller 12 and the second roller 13 in predetermined directions, respectively, to apply the tension T2 to the object. Here, the tension T2 is tension by which the object is stretched, but less than a stretch limit value. A value of the tension T2 is previously stored in the memory unit 52 in correspondence with the type of the object.

Next, in step S105, the control unit 511 of the image processing apparatus 50 outputs an instruction to the liquid discharging apparatus 10 via the output unit 513 to photograph the printed ladder pattern 310*b* (see FIG. 8B) after applying the tension T2 by the camera 17. Upon receiving the instruction, the photograph control unit 213 of the liquid discharging apparatus 10 controls the camera 17 to photograph the printed ladder pattern 310*b*. Photographed image data (second image data) is sent to the image processing apparatus 50, and stored in the memory unit 52 of the image processing apparatus 50.

Next, in step S106, the correction unit 512 of the image processing apparatus 50 reads out the image data of the ladder patterns 310*a* and 310*b* (first image data and second image data) from the memory unit 52, and calculates a degree of stretching of the ladder pattern 310*b* with respect to the ladder pattern 310*a* by an image processing process. For example, as the degree of stretching, "Lb/La" as described above with reference to FIG. 8A and FIG. 8B is obtained.

Next, in step S107, the correction unit 512 of the image processing apparatus 50 corrects the original image data based on the degree of stretching calculated in step S106 to generate corrected image data.

Next, in step S108, the correction unit 512 of the image processing apparatus 50 sends the corrected image data and outputs an instruction to the liquid discharging apparatus 10 via the output unit 513 to print an image on the object based on the corrected image data. Upon receiving the instruction, the print control unit 211 of the liquid discharging apparatus 10 controls the drive circuit 25 to operate the liquid discharging head 15 to print the image based on the corrected image data on the object. Here, in step S108, the tension T2 is continuously applied on the object.

Next, in step S109, the control unit 511 of the image processing apparatus 50 outputs an instruction to the liquid discharging apparatus 10 via the output unit 513 to release the tension T2 from the object. Upon receiving the instruction, the tension control unit 212 of the liquid discharging apparatus 10 controls the drive circuit 26 to rotate the first roller 12 and the second roller 13 in predetermined directions, respectively, to release the tension T2 from the object. With this operation, the object is returned to a normal state (tension by which the object is stretched is not applied).

Although the ladder pattern 310*a* is used to calculate the degree of stretching, this is not limited so. The degree of stretching may be calculated using various geometric test patterns. For example, a logo of a company name or the like may be used as a test pattern. In such a case, the test pattern may be printed at a relatively remarkable location of the object.

Furthermore, steps S101 to S103 and S105 to S107 of FIG. 11 may not be necessarily performed every time, and for example, when printing an image on a plurality of objects of the same kind, a program may be used in which the corrected image data generated for the first object is used for the next objects (second or later objects). In such a case, only steps S104, S108 and S109 are performed for the second and later objects.

As such, according to the liquid discharging system 1 of the first embodiment, an image is printed on an object under a state that the object is stretched by the applied tension T2. With this, floating of the object can be suppressed and adhesion of ink to the object, the paper jam or the like can be suppressed. Thus, waste of the objects due to misprint can be reduced compared with a conventional method.

Further, when printing the image on the object that is stretched by applying the tension T2, the corrected image data corresponding to the tension T2 is used. Thus, the deformation of the image due to shrinking of the object does not occur even when the tension T2 is released, and an image same as the original image can be retained.

Further, by printing the image under a state that the object is stretched by the applied tension T2, the image can be printed at gaps of the net. Thus, lowering of density when the object is stretched can be suppressed and image quality can be improved. Furthermore, as the image printed under the state that the object is stretched is shrunk after the tension is released, the density at the printed surface becomes high and the concentration is improved. With this, more bright color can be printed, compared with a conventional method.

Although an example is described in which the liquid discharging system 1 includes the liquid discharging apparatus 10 and the image processing apparatus 50 in the first embodiment, the CPU 21 of the liquid discharging apparatus 10 may be configured to include the functions of the control unit 511 and the correction unit 512 of the CPU 51 of the image processing apparatus 50. Further, the liquid discharging apparatus 10 may be configured to include the memory unit 52 of the image processing apparatus 50. In such a case, the functions of the liquid discharging system 1 can be actualized only by the liquid discharging apparatus 10.

(Alternative Example of First Embodiment)

According to an alternative example of the first embodiment, an example is described in which an image is corrected by a ratio that is different from the calculated degree of stretching. Here, the same components already described in the first embodiment are given the same reference numerals, and explanations are not repeated in the alternative example of the first embodiment.

In the first embodiment, an example is described in which, when the degree of stretching of the original image after applying the tension T2 with respect to the original image before applying the tension T2 is calculated as "Lb/La", the corrected image data is generated by extending the original image by "Lb/La" in a direction in which the tension T2 is applied.

However, corrected image data may be generated by a ratio of "k*Lb/La" obtained by multiplying a predetermined coefficient "k" to the calculated degree of stretching "Lb/La".

For example, there is a case when a size of a T-shirt is defined assuming that the T-shirt is worn under a state that the T-shirt is stretched (extended) to a certain extent (a sport T-shirt, for example). In such a case, by generating the corrected image data by applying a coefficient "k", (k=0.9, for example) which reduces the degree of stretching, to the degree of stretching "Lb/La" an original image can be displayed when a user of the target wears the T-shirt (object), for example. For example, the user of the target may store the coefficient "k" in the memory unit 52 (or in a memory device 60, which will be described later), and the correction unit 512 may, when the coefficient "k" is stored, multiply the coefficient "k" to the corrected image data based on the degree of stretching to generate new corrected image data.

Further, regardless of the degree of stretching "Lb/La", an image may be printed using data of the original image itself. For example, when tension applied to an object when a user wears the object and tension applied to the object when printing an image are the same, and original image data is prepared by taking the extension of the object when being worn into consideration, by printing an image using the original image data without correcting it, an original image can be displayed when the user of the object wears the object.

Second Embodiment

In a second embodiment, an example of a liquid discharging system including a memory device instead of the image processing apparatus 50 is described. Here, the same components already described in the first embodiment are given the same reference numerals, and explanations are not repeated in the second embodiment.

Figure 12:
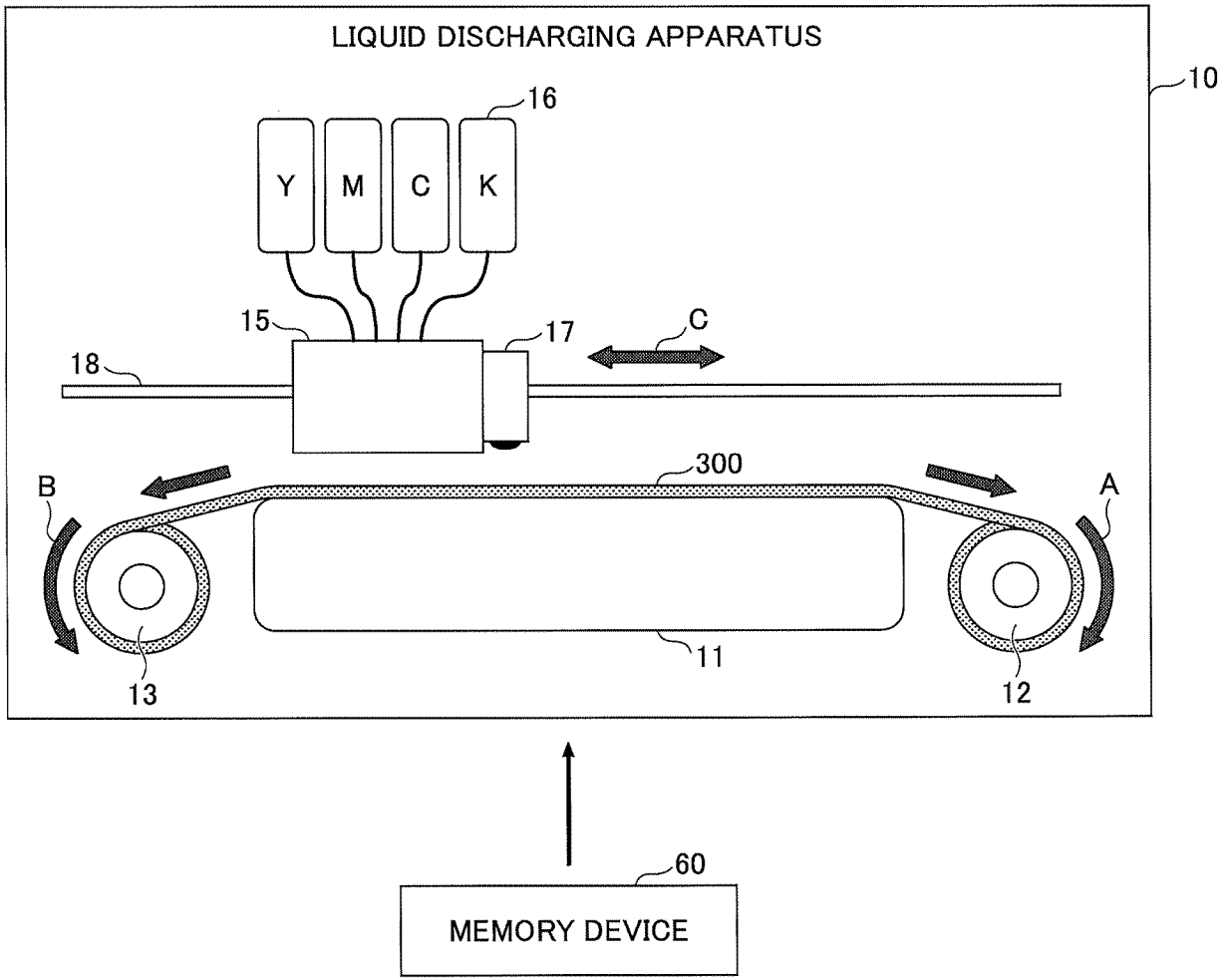
FIG. 12 is a view illustrating an example of a structure of a liquid discharging system of a second embodiment.

FIG. 12 is a view illustrating an example of a structure of a liquid discharging system 2 of the second embodiment. With reference to FIG. 12, the liquid discharging system 2 includes the liquid discharging apparatus 10 and a memory device 60 as main constituents. The liquid discharging apparatus 10 and the memory device 60 may be connected by wired or wireless communication.

For the memory device 60, for example, a semiconductor device including a nonvolatile semiconductor element, a hard disk drive, an optical disk drive or the like may be used. Alternatively, for the memory device 60, the memory unit 52 of the image processing apparatus 50 (see FIG. 1, for example) may be used.

Similar to the first embodiment, the liquid discharging apparatus 10 prints (forms) an image on the object 300 under a state that the tension T2, by which the object 300 is stretched, is applied by the first roller 12 and the second roller 13, by discharging liquid (ink) from the liquid discharging head 15.

At this time, data of the degree of stretching of an image printed on the object 300 under a state that the tension T1 is applied with respect to an image printed on the object 300 under a state that the tension T2 is applied is necessary. Here, as described above, the object 300 is not stretched by the tension T1 while the object 300 is stretched by the tension T2. Furthermore, the degree of stretching may be "Lb/La" described above in the first embodiment with reference to FIG. 8A and FIG. 8B, for example.

According to the first embodiment, when an object is selected, a test pattern is printed under a state that the tension T1 is applied, and thereafter, the degree of stretching is measured by applying the tension T2. Meanwhile, in the second embodiment, corrected image data prepared based on a value of the tension T2 or a degree of stretching of previously measured images under the tension T1 and the tension T2 is stored in the memory device 60 for each type of the object such as cotton, hemp, polyester or nylon, for example. Here, the CPU 21 of the liquid discharging apparatus 10 may include a part of the functions of the control unit 511 of the CPU 51 of the image processing apparatus 50 of the first embodiment.

Figure 13:
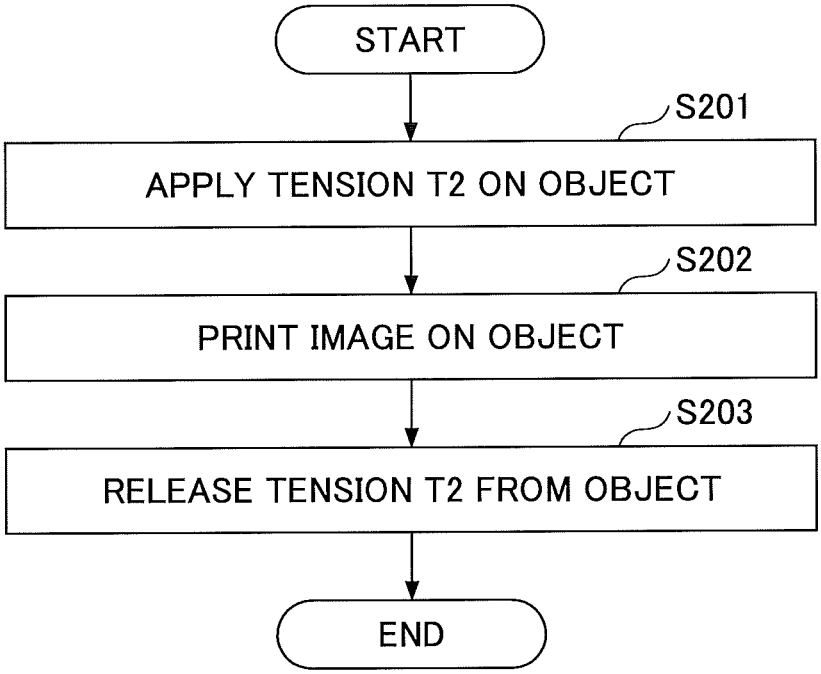
FIG. 13 is a view illustrating an example of a process flow of the liquid discharging system of the second embodiment.

FIG. 13 is a view illustrating a process flow of the liquid discharging system 2 of the second embodiment. FIG. 13 illustrates an example of the process flow from applying tension to forming image.

First, an operator of the liquid discharging system 2 selects a type of a print target object (hereinafter, simply referred to as a "target" as well) on which an image is to be printed, and inputs the kind in the liquid discharging apparatus 10. The type of the object is selected from cotton, hemp, polyester and nylon, for example.

Then, in step S201, the tension control unit 212 of the liquid discharging apparatus 10 reads out tension T2 corresponding to the selected kind (material) from the memory device 60 via the I/F 24. Then, the tension control unit 212 controls the drive circuit 26 to rotate the first roller 12 and the second roller 13 in predetermined directions, respectively, to apply the tension T2 to the object.

Next, in step S202, the print control unit 211 of the liquid discharging apparatus 10 reads out the corrected image data corresponding to the selected kind (material) from the memory device 60 via the I/F 24. Then, the print control unit 211 controls the drive circuit 25 to operate the liquid discharging head 15 to print an image based on the corrected image data on the object. Here, in step S202, the tension T2 is continuously applied on the object.

Next, in step S203, the tension control unit 212 of the liquid discharging apparatus 10 controls the drive circuit 26 to rotate the first roller 12 and the second roller 13 in predetermined directions, respectively, to release the tension T2 from the object. With this operation, the object is returned to a normal state (tension by which the object is stretched is not applied). With this, formation of the image is finished.

As such, according to the liquid discharging system 2 of the second embodiment, when the object is selected, it is only necessary to read out information regarding the degree of stretching of the image corresponding to the selected object from the memory device 60. Thus, it is unnecessary to generate the corrected image data as described in the first embodiment. Thus, printing of the image on the object 300 can be easily performed within a shorter period. Other effects are the same as those of the liquid discharging system 1 of the first embodiment.

Further, the degree of stretching may be measured for each material according to the steps described above in the first embodiment. Then, a table in which the measured degree of stretching is in correspondence with the material may be prepared and stored in the memory device 60.

Although an example is described in which the liquid discharging system 2 includes the liquid discharging apparatus 10 and the memory device 60 in the second embodiment, the liquid discharging apparatus 10 may include a function of the memory device 60 as a memory unit. For example, for the memory unit that includes the function of the memory device 60, the RAM 23 (see FIG. 3) of the liquid discharging apparatus 10 may be used. In such a case, the functions of the liquid discharging system 2 can be actualized only by the liquid discharging apparatus 10.

Third Embodiment

In a third embodiment, an example of a tension applying unit different from that of the first and second embodiments is described. Here, the same components already described in the first and second embodiments are given the same reference numerals, and explanations are not repeated in the third embodiment.

Figure 14A:
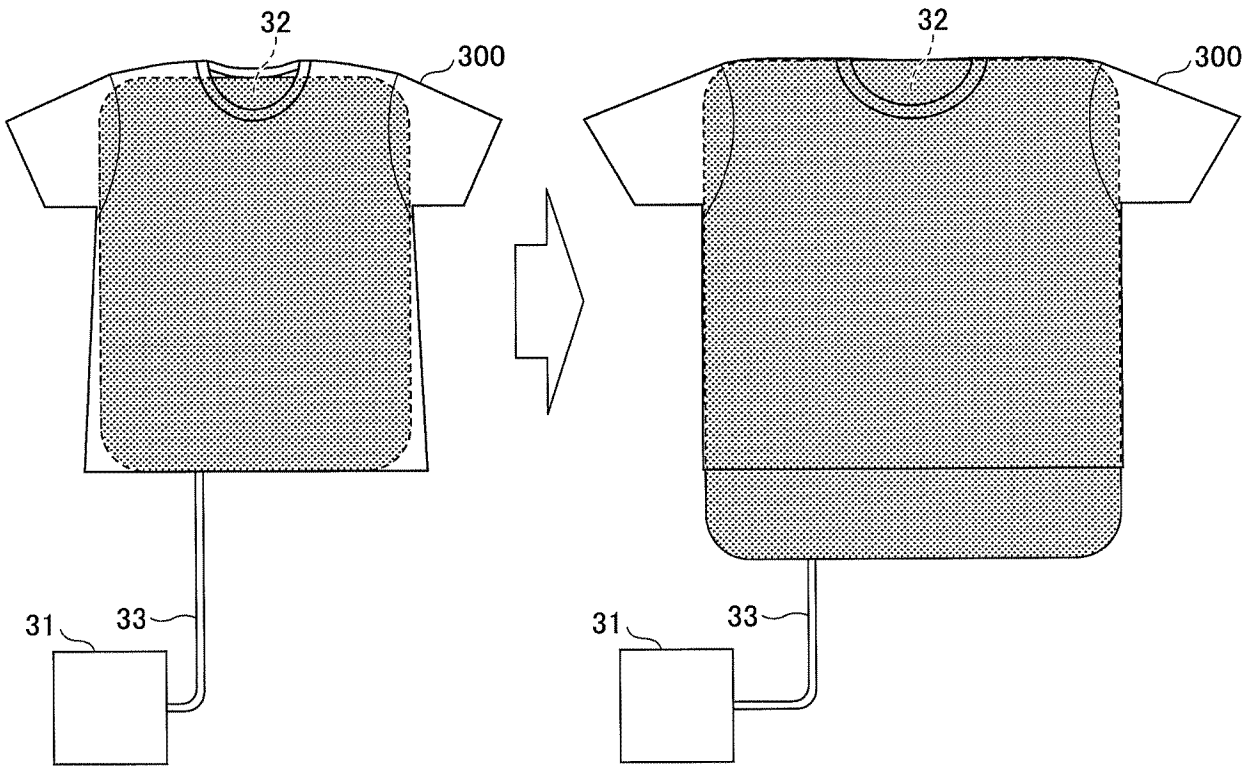
FIG. 14A and FIG. 14B are views illustrating an example of a structure of a tension applying unit of a third embodiment.
Figure 14B:
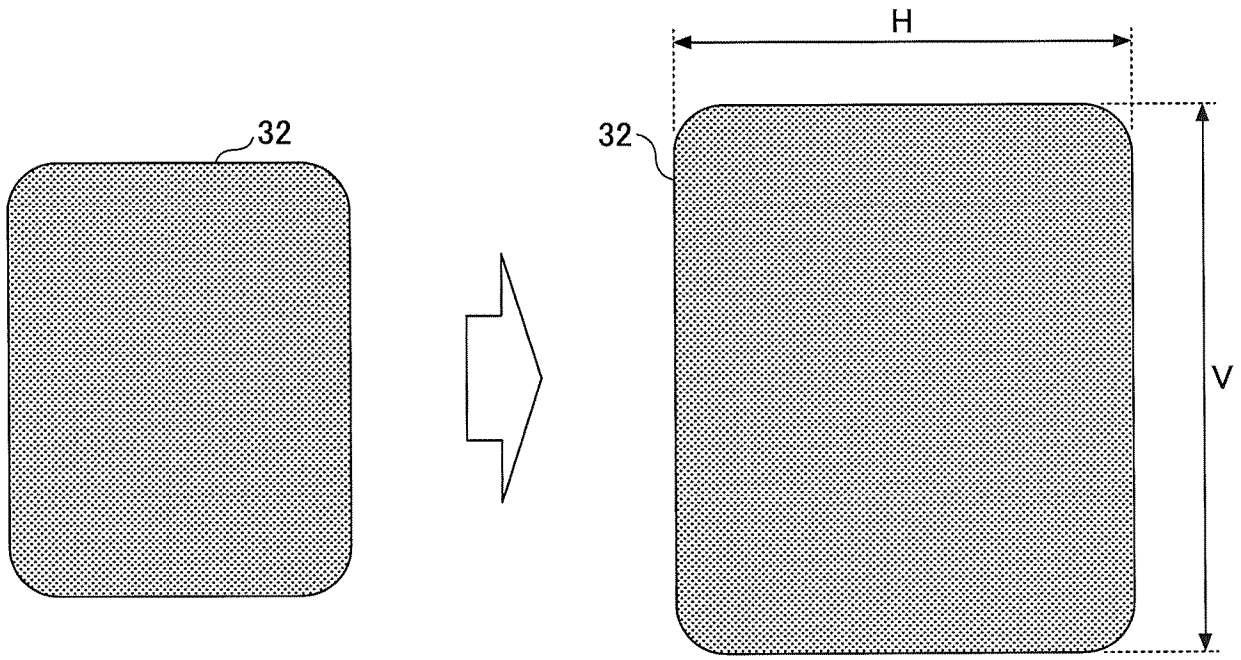

FIG. 14A and FIG. 14B are views illustrating an example of a tension applying unit of the third embodiment. With reference to FIG. 14A and FIG. 14B, the tension applying unit of the third embodiment includes an air pump 31 and an air bag 32.

The air pump 31 and the air bag 32 are connected via a tube 33. The liquid discharging apparatus of the third embodiment may be configured by displacing the fixed table 11, the first roller 12 and the second roller 13 illustrated in FIG. 1 by the air pump 31, the air bag 32 and the tube 33. The air pump 31 and the air bag 32 are a typical example of a tension applying unit.

The air pump 31 is an air volume control unit that controls an air volume in the air bag 32. The air pump 31 may be driven by a motor to control the air volume in the air bag 32 by discharging air into the air bag 32 or absorbing air from the air bag 32. When the air pump 31 is driven by the motor, the motor may be connected to the drive circuit 26 and may be controlled by the tension control unit 212.

The air bag 32 is a bag member wrapped by the object 300. Variable tension may be applied to the object 300 by adjusting the size of the air bag 32 by varying the air volume in the air bag 32, which is wrapped by the object 300, by the air pump 31.

For example, the object 300 may be wrapped by the air bag 32 under a state as illustrated at left in FIG. 14A, at which the air volume in the air bag 32 is small. Thereafter, as illustrated at right in FIG. 14A, tension by which the object 300 is stretched may be applied to the object 300 by discharging air from the air pump 31 to the air bag 32 to inflate the air bag 32. As the size of the air bag 32 can be controlled by the air pump 31, tension with an appropriate strength in accordance with the type of the object 300 can be applied.

Here, as illustrated in FIG. 14B, the air bag 32 expands, not only in accordance with a shape of the object 300, but into a substantially rectangular shape for facilitating printing. With this, as illustrated at right in FIG. 14B, the object 300 can be stretched not only in a lateral direction "H" but also in a vertical direction "V" by applying the tension in both the lateral direction "H" and the vertical direction "V".

As a result, an image can be furthermore appropriately printed on inside of the net that is exposed when the object 300 is stretched, and lowering of density when the object 300 is stretched can be furthermore suppressed. Other effects are the same as those of the liquid discharging system 1 of the first embodiment.

When the air pump 31 and the air bag 32 are used as the tension applying unit, the tension is not only applied in the lateral direction "H" but also in the vertical direction "V". Thus, it is necessary to use corrected image data in which correction is performed for not only in the lateral direction "H" but also for in the vertical direction "V". In such a case, each area of the original image data 320 divided by the grids as illustrated in FIG. 9 may be extended in accordance with the degree of stretching of the object 300 in both the lateral direction and the vertical direction.

According to the embodiment, a liquid discharging apparatus capable of forming an appropriate image on an object even when the image is printed under a state that the object is stretched is provided.

Although a preferred embodiment of the liquid discharging apparatus, the image processing apparatus and the liquid discharging system has been specifically illustrated and described, it is to be understood that minor modifications may be made therein without departing from the spirit and scope of the invention as defined by the claims.

The present invention is not limited to the specifically disclosed embodiments, and numerous variations and modifications may be made without departing from the spirit and scope of the present invention.

What is claimed is:

1. A liquid discharging apparatus comprising:

a tension applying unit configured to apply a predetermined tension capable of stretching an object, to the object; and a liquid discharging head configured to discharge liquid on the object that is stretched by the predetermined tension applied by the tension applying unit to form an original image or a corrected image of the original image on the object, the corrected image being corrected by a degree of stretching of a predetermined image when the object on which the predetermined image is formed is stretched by applying the predetermined tension to the object, wherein the tension applying unit includes a bag member that is to be wrapped by the object, capable of storing air inside, and capable of inflating and shrinking, and an air volume control unit configured to control air volume in the bag member, and wherein the air volume control unit is configured to vary the air volume in the bag member wrapped by the object to control a size of the bag member and to apply tension to the object.

2. The liquid discharging apparatus according to claim 1, wherein the predetermined tension is less than a stretch limit value by which the object cannot return to an original shape of the object before applying the tension even when the tension applied to the object is released.

3. The liquid discharging apparatus according to claim 1, wherein the object stretched by the tension applying unit is hemp, cotton, polyester or nylon.

4. The liquid discharging apparatus according to claim 1, wherein the predetermined image is an image formed on the object under a state that the object is not stretched.

5. The liquid discharging apparatus according to claim 1, further comprising:

a memory; and a processor that executes a program stored in the memory to perform a step of generating data of the corrected image.

6. The liquid discharging apparatus according to claim 5, further comprising:

a camera configured to photograph the predetermined image formed on the object that is not stretched to obtain first image data, and photograph the predetermined image formed on the object when the object on which the predetermined image is formed is stretched by applying the predetermined tension to obtain second image data, wherein the generating performed by the processor includes calculating a degree of stretching of the predetermined image before and after applying the predetermined tension using the first image data and the second image data, and generating the data of the corrected image based on the degree of stretching of the predetermined image.

7. The liquid discharging apparatus according to claim 1, further comprising:

a memory device that stores the data of the corrected image that is previously generated.

8. The liquid discharging apparatus according to claim 1, wherein the tension applying unit applies the predetermined tension in a direction that is perpendicular to a transferring direction of the object.

9. The liquid discharging apparatus according to claim 1, wherein the liquid discharging head discharges the liquid on the object that is stretched by the predetermined tension applied by the tension applying unit to form the corrected image of the original image on the object such that deformation of the original image does not occur on the object when the predetermined tension is released from the object.

10. A liquid discharging system comprising:

the liquid discharging apparatus according to claim 1; and a memory device configured to store the value of the predetermined tension corresponding to a type of the object on which the image is to be formed, and data of the corrected image, wherein the tension applying unit applies the predetermined tension on the object based on the value of the predetermined tension stored in the memory device, and wherein the liquid discharging head forms the corrected image on the object in accordance with the data of the corrected image stored in the memory device.

11. A liquid discharging system comprising:

the liquid discharging apparatus according to claim 1; and an image processing apparatus including a memory device configured to store a value of the predetermined tension corresponding to a type of the object on which an image is to be formed, and generating the data of the corrected image, wherein the tension applying unit applies the predetermined tension on the object based on the value of the predetermined tension stored in the memory device, and wherein the liquid discharging head forms the corrected image on the object in accordance with the data of the corrected image obtained from the image processing apparatus.

* * * * *